US007047602B2

(12) United States Patent
Wang

(10) Patent No.: US 7,047,602 B2
(45) Date of Patent: May 23, 2006

(54) TAB MECHANISM

(76) Inventor: Wallace Wang, No. 273, San Chun St., Taipei Hsien (TW)

( * ) Notice: Subject to any disclaimer, the term of this patent is extended or adjusted under 35 U.S.C. 154(b) by 0 days.

(21) Appl. No.: 10/795,308

(22) Filed: Mar. 9, 2004

(65) Prior Publication Data

US 2005/0198789 A1 Sep. 15, 2005

(51) Int. Cl.
*A44B 19/26* (2006.01)

(52) U.S. Cl. ..... 24/430; 24/429

(58) Field of Classification Search ..... 24/415, 24/429, 430, 431
See application file for complete search history.

(56) References Cited

U.S. PATENT DOCUMENTS 5,093,966 A * 3/1992 Yuki et al. ..... 24/429
5,347,692 A * 9/1994 Ebata ..... 24/429
5,690,444 A * 11/1997 Yuuki et al. ..... 24/429
5,878,467 A * 3/1999 Yokota ..... 24/429
5,930,874 A * 8/1999 Yamazaki et al. ..... 24/429
6,581,254 B1 * 6/2003 Tang ..... 24/429
2005/0022346 A1 * 2/2005 Wang ..... 24/429

* cited by examiner

*Primary Examiner*—Robert J. Sandy
*Assistant Examiner*—Ruth C. Rodriguez
(74) *Attorney, Agent, or Firm*—Rosenberg, Klein & Lee

(57) ABSTRACT

A tab mechanism adopted for a zipper slide has a connection member having a hanging portion connecting the zipper slide and a clamping portion downwardly extending from the hanging portion. A locking structure having a top end connects the clamping portion of the connection member and a bottom end for hanging an object. The locking structure includes a male buckle and a female buckle clamping on and detachable from the male buckle for easily hanging an identification card, a toy, a whistle, a cell phone, or similar objects to avoid loss and damage.

12 Claims, 12 Drawing Sheets

TAB MECHANISM

BACKGROUND OF THE INVENTION

1. Field of the Invention

The present invention relates to a tab mechanism, and particularly relates to a locking structure secured on or multi-rotating about a tab mechanism and engaging with a hanging object.

2. Background of the Invention

Typical zippers are popular and generally used in everyday life due to their easy and rapid engagement and disengagement. Clothing, a bag, a wallet, and even a jacket may have a plurality of zippers arranged thereon for both utility and decoration. However, the zippers nowadays still retain original functions as well as engagement and disengagement.

Referring to FIG. 1, a conventional zipper 10*a* adopted for a pocket includes two teeth tapes 20*a*, a plurality of teeth 30*a* respectively arranged on the two teeth tapes 20*a*, a slide 40*a* engaging with the teeth tapes 20*a*, and a tab 50*a* connecting and hanging on the slide 40*a*. The tab 50*a* is used for pulling the slide 40*a* to engage or disengage the two teeth tapes 20*a*.

The conventional zipper 10*a* usually prevents valuables, such as a cell phone, from getting lost or being dropped and damaged. But, if a user forgets to close the conventional zipper 10*a*, the valuables are still easily lost or dropped.

Hence, an improvement over the prior art is required to overcome the disadvantages thereof.

SUMMARY OF INVENTION

The primary object of the invention is therefore to specify a tab mechanism on which an identification card, a toy, a whistle, a cell phone, or objects the like are hung to avoid loss and damage.

The secondary object of the invention is therefore to specify a tab mechanism, in which the tab and the locking structures can be rotated about each other.

The third object of the invention is therefore to specify a tab mechanism, in which the tab and the locking structure can be firmly secured to each other.

According to the invention, this primary object is achieved by a tab mechanism adopted for a zipper slide. The tab mechanism includes a connection member having a hanging portion connecting the zipper slide and a clamping portion downwardly extending from the hanging portion. A locking structure having a top end connects the clamping portion of the connection member and an object is hung from a bottom end.

According to the invention, this secondary object is achieved by the locking structure, which is a sphere junction. The sphere junction includes a sphere body, and a connection portion under and connecting to the sphere body. The sphere body can be clamped in the clamping portion for multi-directional rotation.

According to the invention, this third object is achieved by the clamping portion, which is shaped like a plate. The clamping portion has a plurality of slots. The locking structure is a plate, and the locking structure includes an engaging portion secured in the slot and a detachable hook structure arranged beneath the engaging portion for hanging the object.

To provide a further understanding of the invention, the following detailed description illustrates embodiments and examples of the invention. Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE EMBODIMENTS

Figure 1:
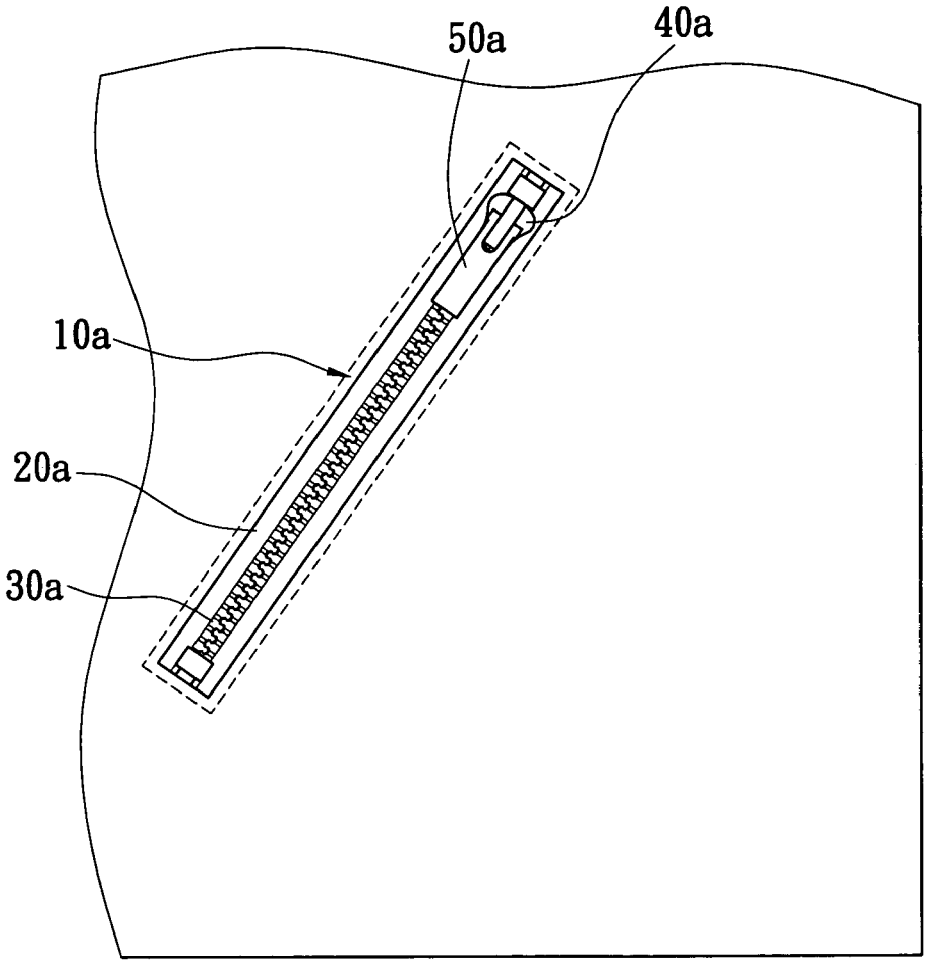
FIG. 1 PRIOR ART
FIG. 1 is a perspective view of a conventional zipper.
Figure 2:
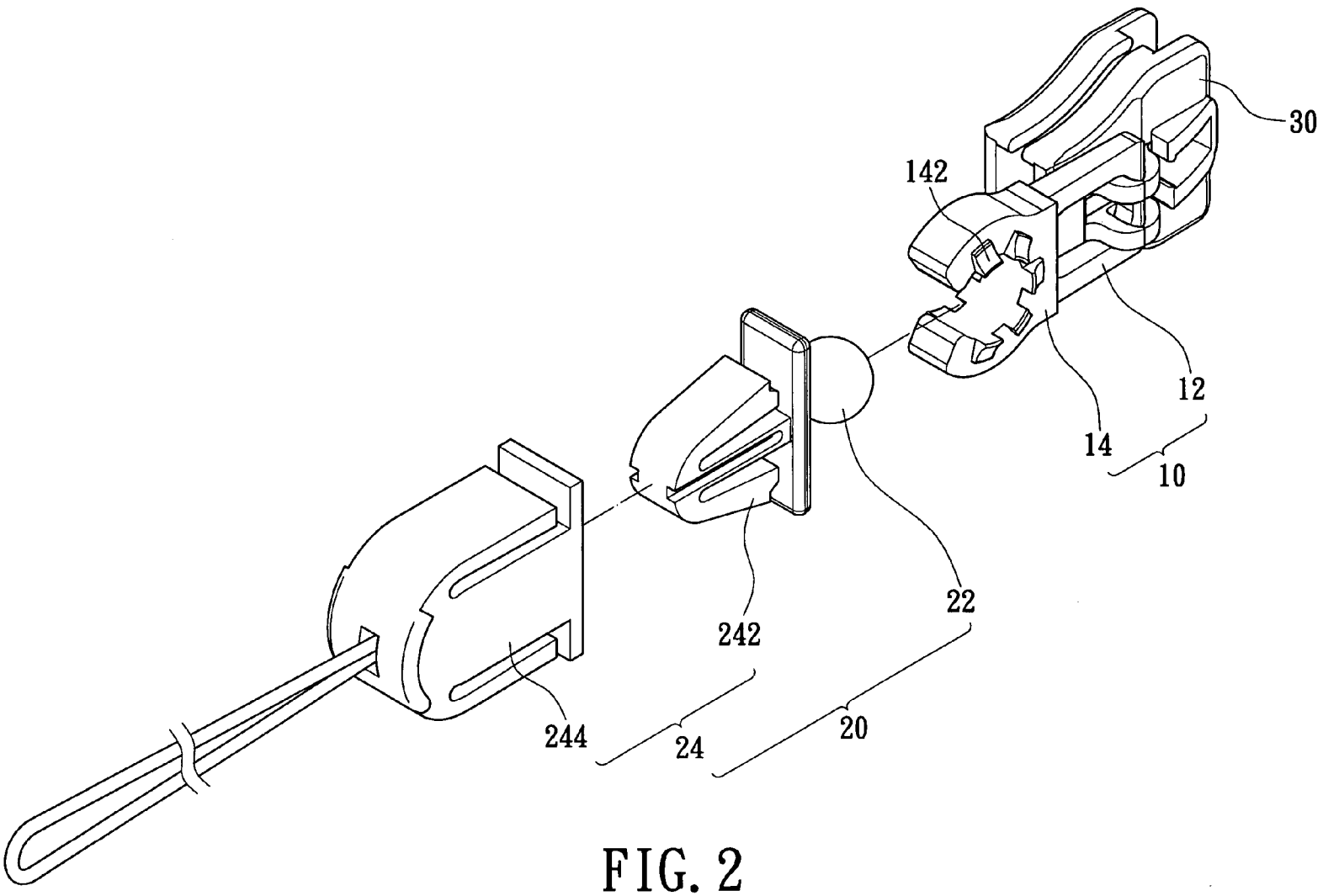
FIG. 2 is a decomposition view of a tab mechanism according to the present invention.
Figure 3:
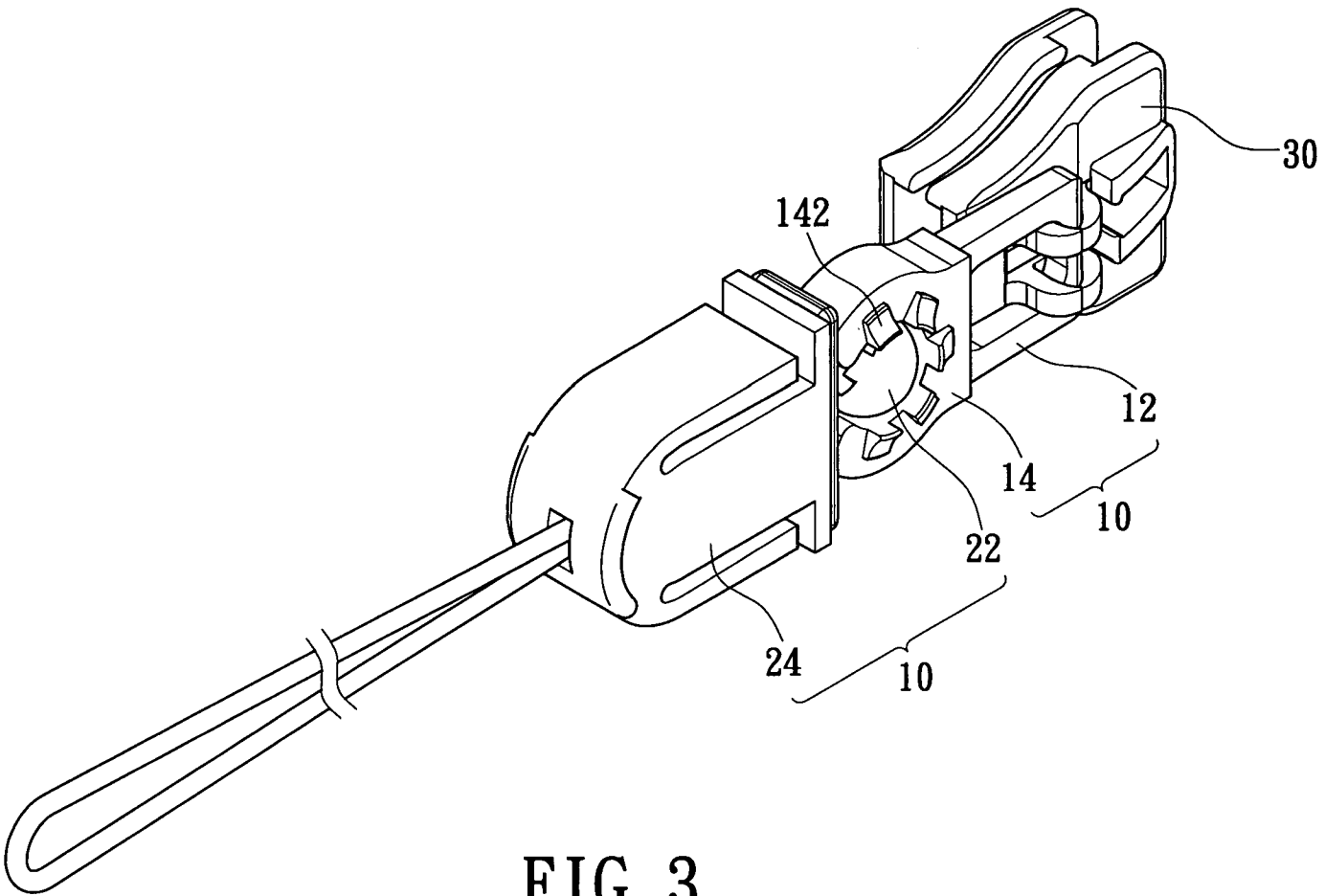
FIG. 3 is a perspective view of the tab mechanism according to the present invention.
Figure 4:
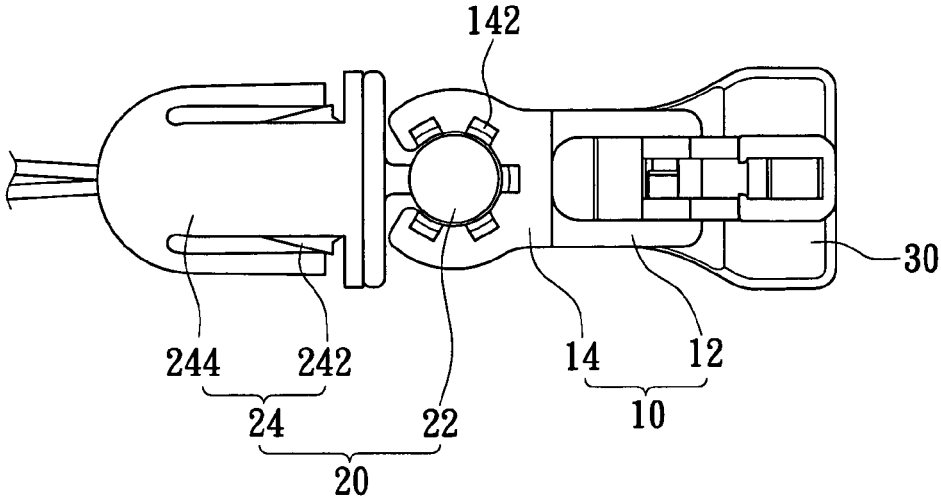
FIG. 4 is a top view of the tab mechanism according to the present invention.
Figure 5:
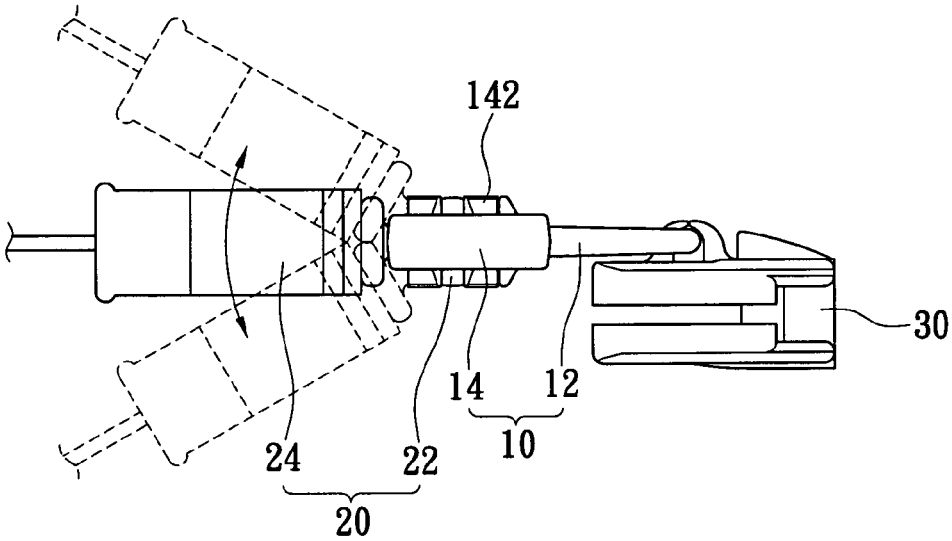
FIG. 5 is a side view of the tab mechanism according to the present invention.

Referring to FIGS. 2 to 5, the present invention provides a tab mechanism adopted for a zipper slide 30 arranged on two teeth tapes. The tab mechanism includes a connection member 10 and a locking structure; the best embodiment of the locking structure is a sphere junction 20.

The connection member 10 includes a hanging portion 12 connecting the zipper slide 30 and a clamping portion 14 downwardly extending from the hanging portion 12.

The sphere junction 20 includes a sphere body 22, a connection portion 24 under and connecting to the sphere body 22. The sphere body 22 can be clamped in the clamping portion 14 for multi-directional rotation. The best embodiment of the connection portion 24 is a detachable hook structure 24 including a bottom end for hanging an object.

The clamping portion 14 includes a plurality of curved teeth 142 respectively inwardly extending from a front inner flange and a rear inner flange of the clamping portion 14 to prevent the sphere body 22 from disengaging. The detachable hook structure 24 includes a male buckle 242 made integrally from the sphere body 22 in one piece and a female buckle 244 clamping with the male buckle 242. The female buckle 244 has a rope penetrating therethrough to tie and hang the object. The female buckle 244 has a base and a pair of resilient members upwardly and laterally extending from a bottom of the base; the resilient members are each spaced by a gap from the base. Therefore, an identification card, a toy, a whistle, a cell phone, or similar objects can be hung on the tab mechanism to avoid loss and damage, and even for rotation in multiple directions.

Figure 6:
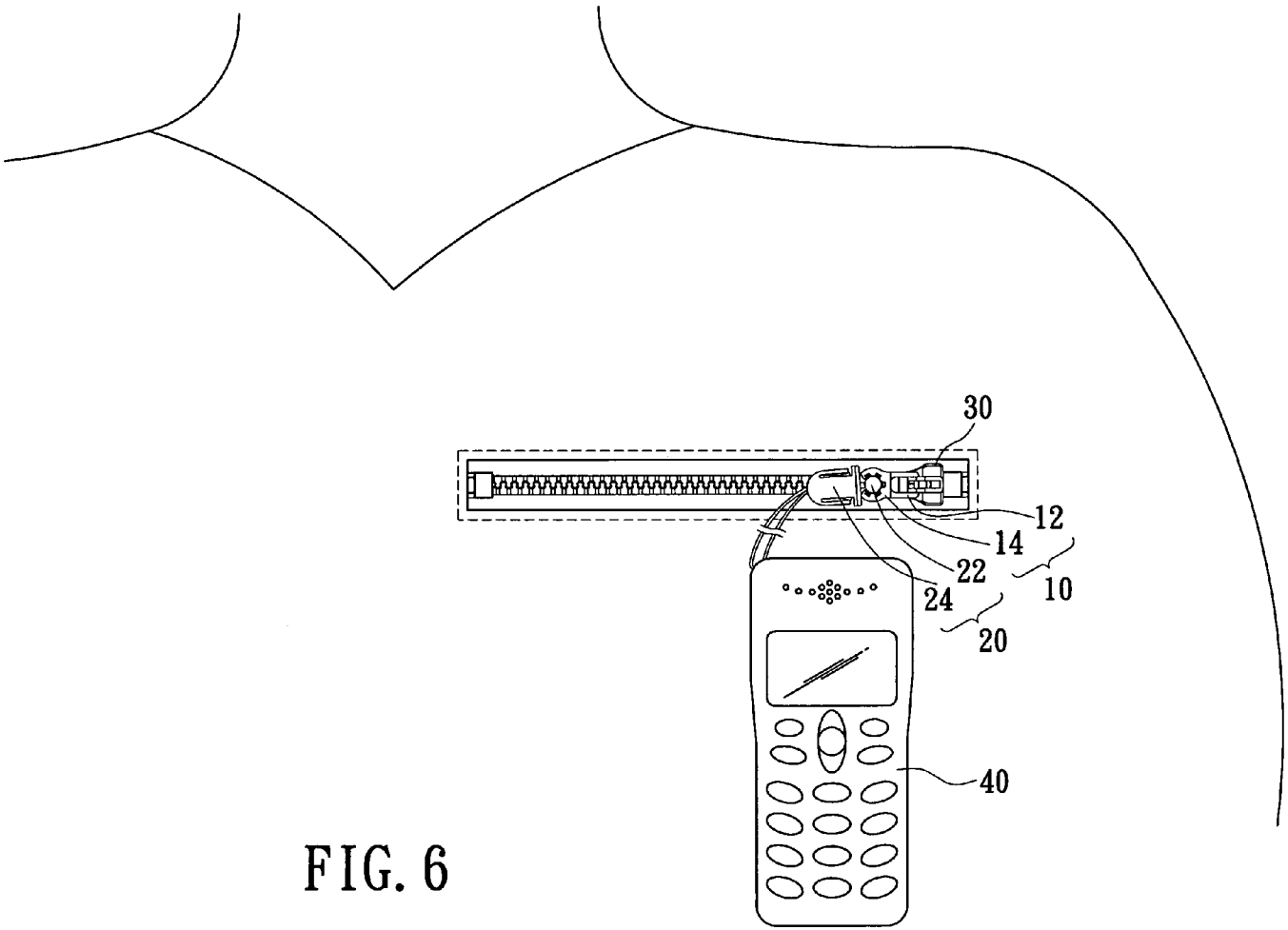
FIG. 6 is a perspective view according to a first embodiment of the tab mechanism adopted for a pocket with a cell phone hung thereon.

With respect to FIG. 6, the tab mechanism can be equipped with a cell phone 40 hung thereon, and the cell phone 40 can be disposed in the pocket.

Figure 7:
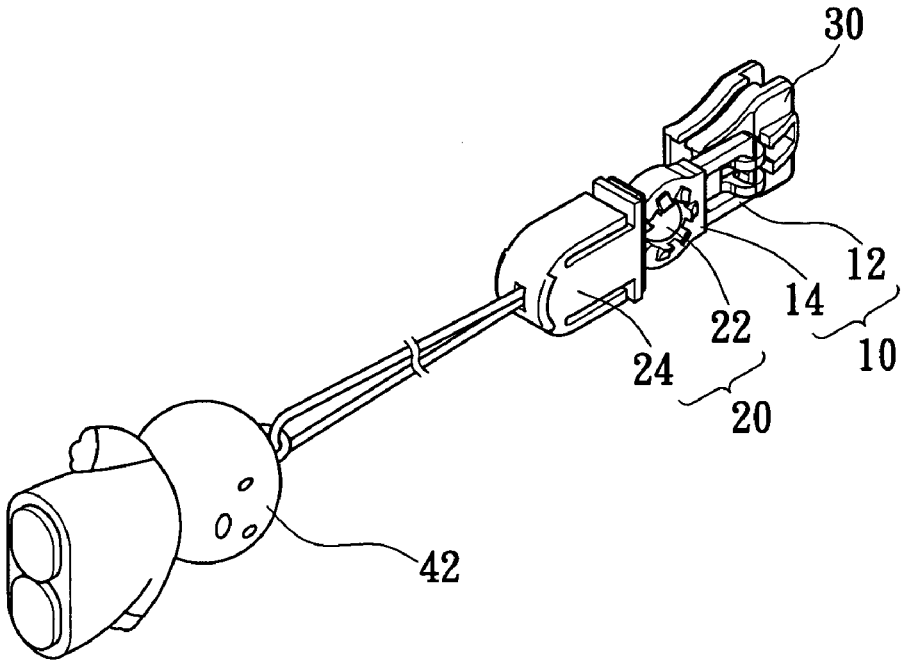
FIG. 7 is a perspective view according to a second embodiment of the tab mechanism with a toy hung thereon.

FIG. 7 illustrates a toy 42, such as, for example, a doll, combined with the tab mechanism according to the present invention.

Figure 8:
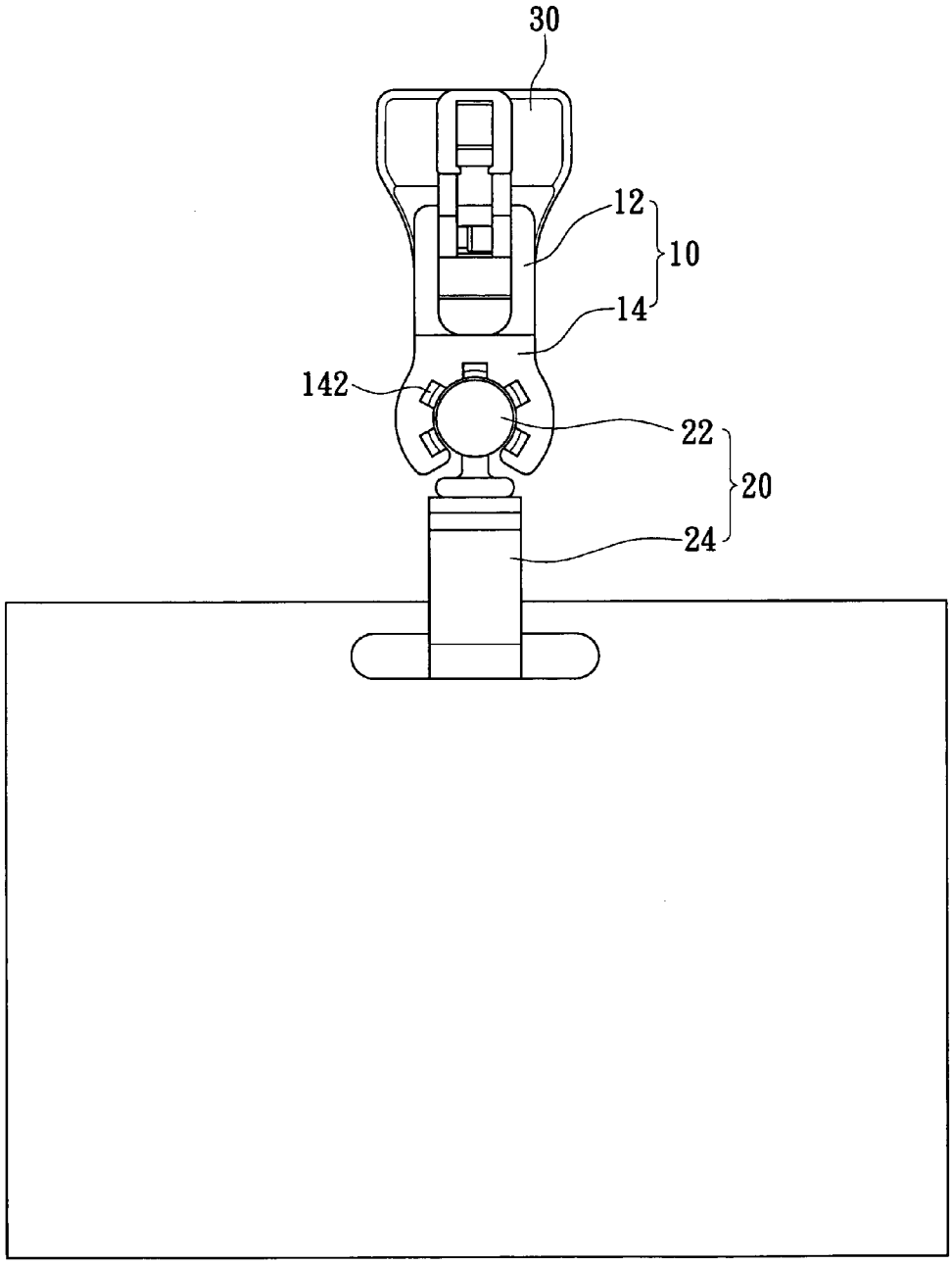
FIG. 8 is a perspective view according to a third embodiment of the tab mechanism with an identification card hung thereon.

FIG. 8 shows the identification card suspended by the tab mechanism. The identification card engages with the gap within the resilient member as long as the female buckle 244 turns around.

Figure 9:
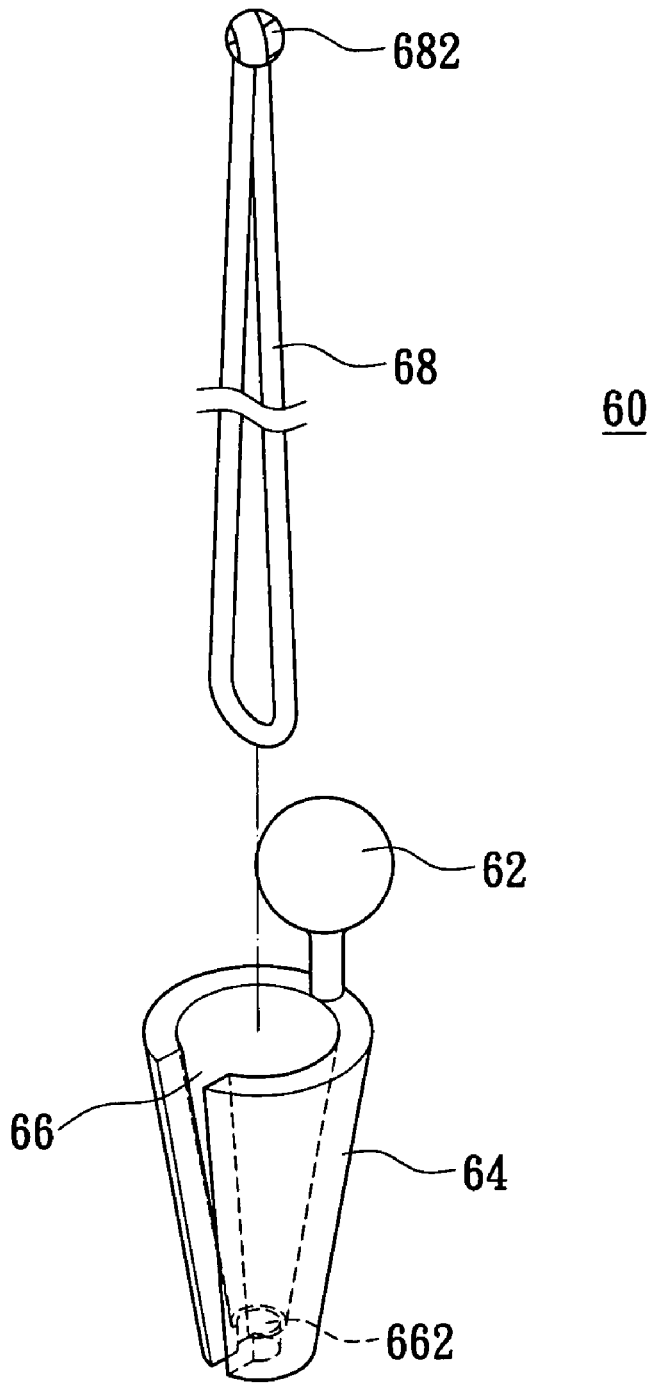
FIG. 9 is a decomposition view according to a fourth embodiment of the combined with locking structure.
Figure 10:
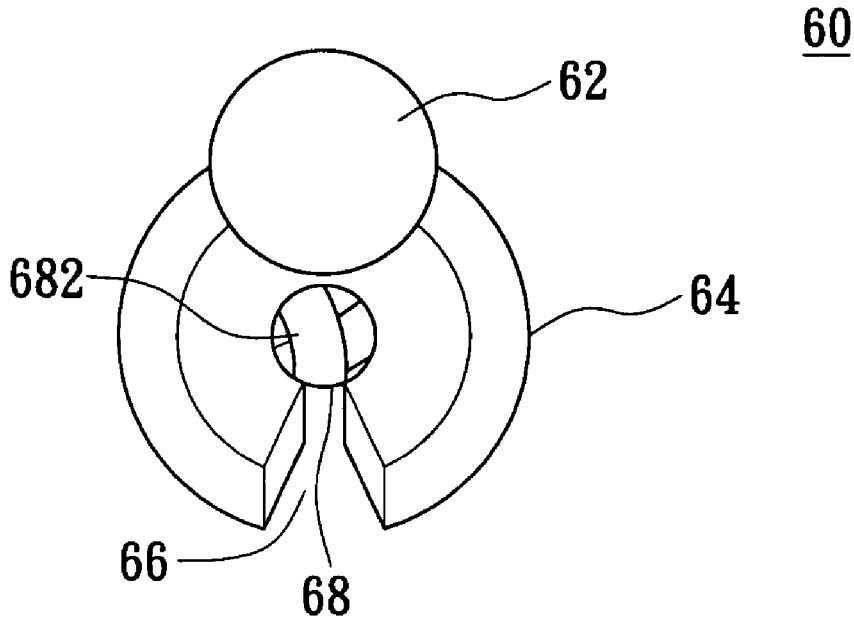
FIG. 10 is a top view according to the fourth embodiment of the combined with locking structure.
Figure 11:
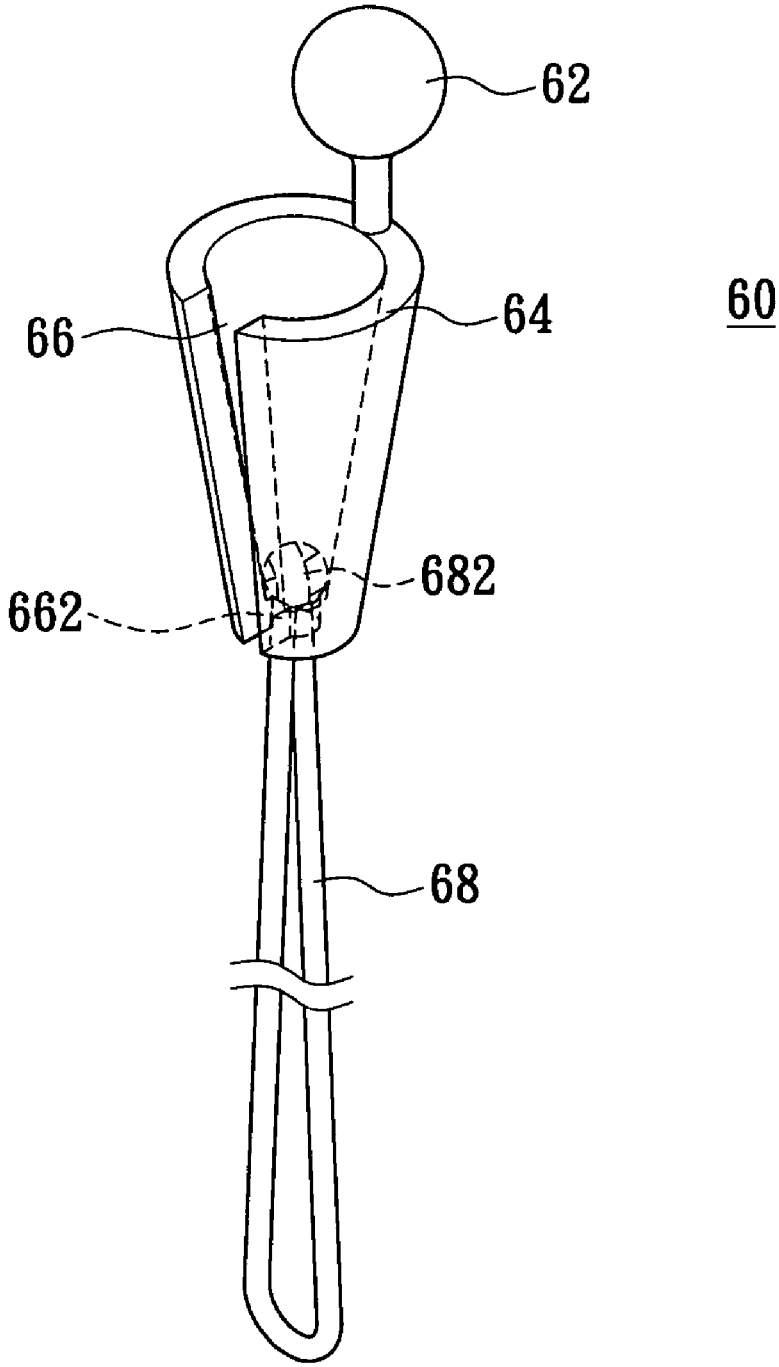
FIG. 11 is a perspective view according to the fourth embodiment of the combined with locking structure.

Referring to FIGS. 9 to 11, the present invention provides a locking structure 60 to prevent an object from being lost. The locking structure 60 includes a sphere body 62 and a connection portion 64 under and connecting to the sphere body 62. The sphere body 62 can be clamped in the clamping portion 14 for multi-directional rotation. In this embodiment, the connection portion 64 is a bind-around member downwardly extending from a bottom of the sphere body 62 and made integrally in one piece, and the bind-around member has a gradual-reduced circular sidewall of a funnel shape. The bind-around member has a seam 66 formed from a top of the circular sidewall downwardly and a rope 68 engaged in a bottom 662 of the seam 66 to hang the object. The rope 68 has a knot 682 engaging with the bottom 662 of the seam 66 for the locking structure 60 rotates in a multiple direction; the rope 68 is detachable and can be combined with the object first and then engaged in the bind-around member.

Figure 12:
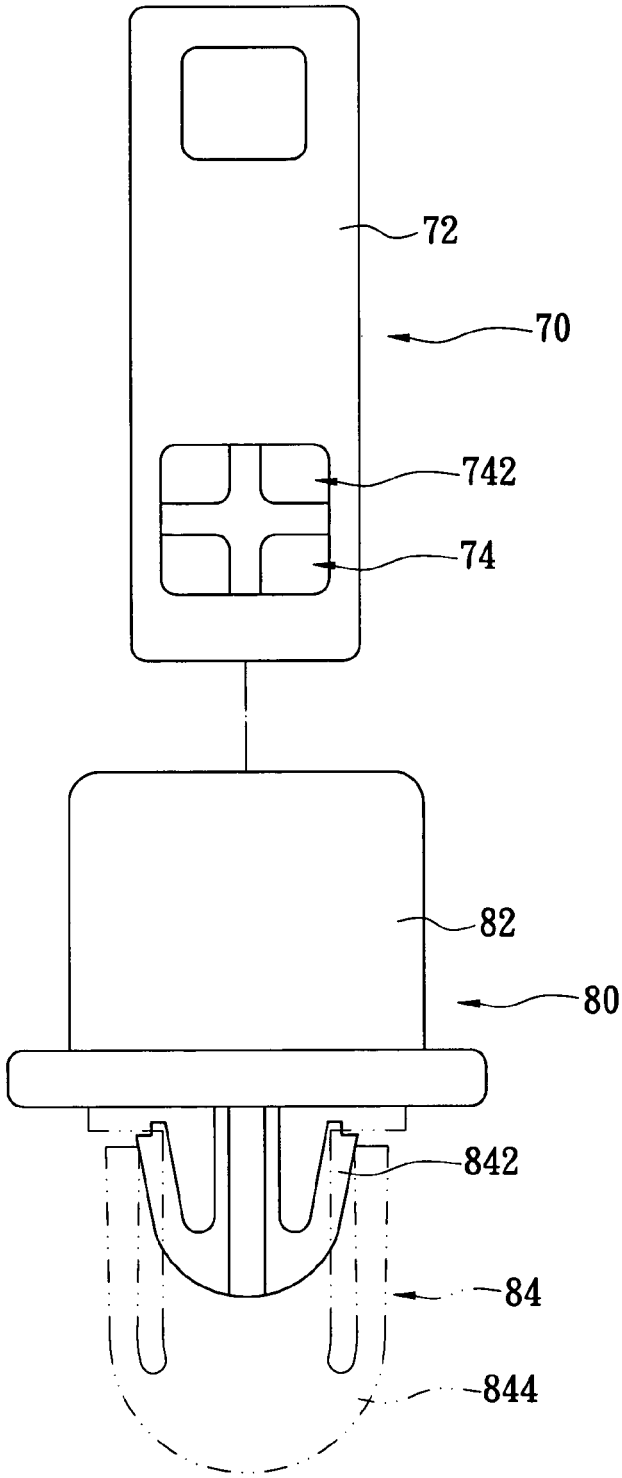
FIG. 12 is a from view according to the fourth embodiment of the combined with locking structure while the locking structure assembles therein.
Figure 13:
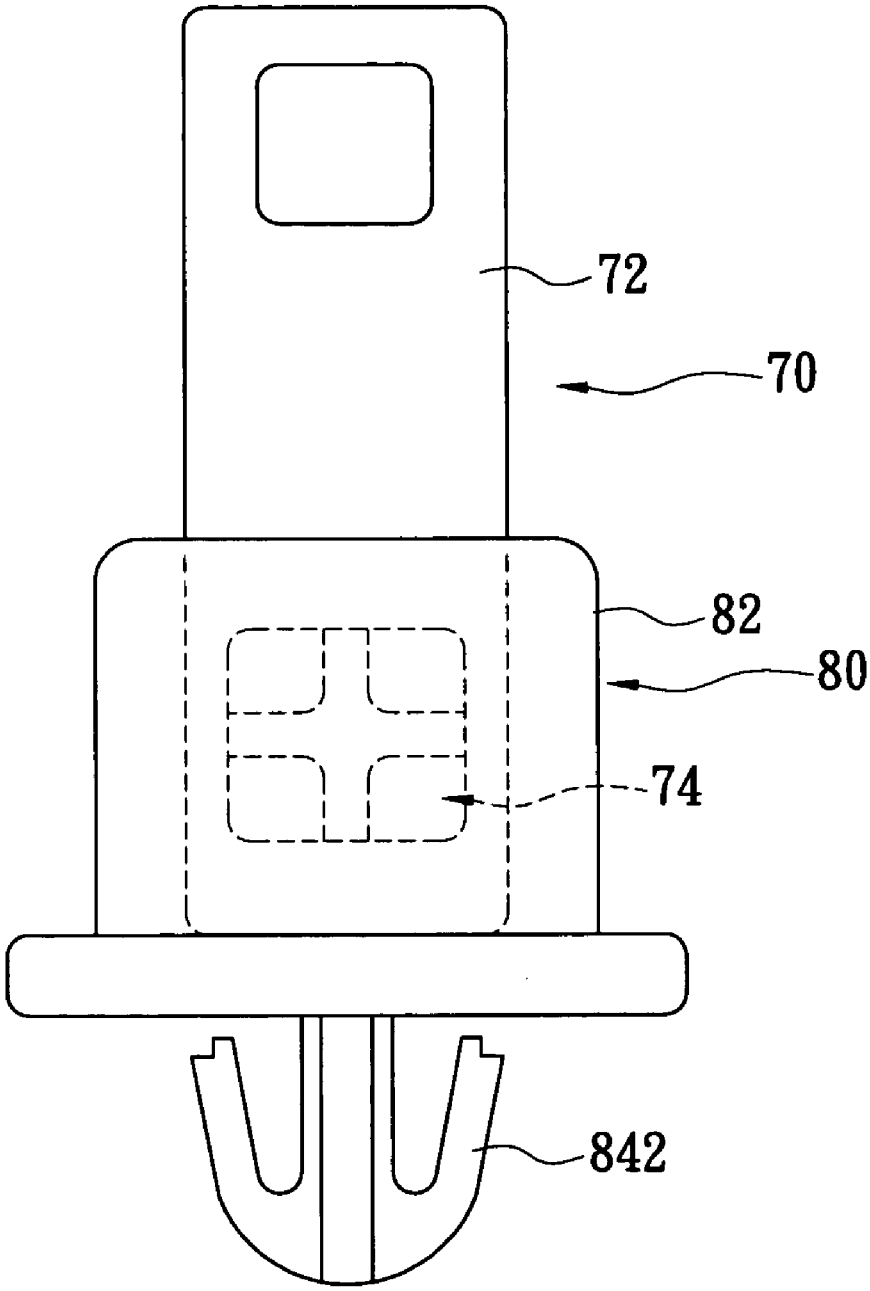
FIG. 13 is a from view according to the fourth embodiment of the combined with locking structure while a connection member assembles therein.

With respect to FIGS. 12 to 13, the present provides a tab mechanism including a connection member 70 and a locking structure 80 secured to the connection member 70 in this embodiment. The connection member 70 includes a hanging portion 72 connecting the zipper slide and a clamping portion 74 downwardly extending from the hanging portion 72.

The clamping portion 74 is shaped like a plate and has a plurality of slots 742. The locking structure 80 is plate shaped, and the locking structure 80 includes an engaging portion 82 secured in the slot 742 and a detachable hook structure 84 arranged beneath the engaging portion 82. The detachable hook structure 84 provides configurations as well as the embodiment mentioned above. The detachable hook structure 84 includes a male buckle 842 extending from the plate-shaped locking structure 80 and a female buckle 844 engaging with the male buckle 842. The female buckle 844 has a rope penetrating therethrough to tie and hang the object.

The locking structure 80 can be alternatively plate-shaped and extending downwardly from the clamping portion 74 and integrally in one piece, the plate-shaped locking structure 80 has a detachable hook structure 84 connecting to a bottom thereof for engagement or disengagement.

It should be apparent to those skilled in the art that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A tab mechanism adopted for a zipper slide, the tab mechanism comprising:

a connection member including a hanging portion connecting the zipper slide and a clamping portion downwardly extending from the hanging portion; and a locking structure having a top end connecting the clamping portion of the connection member and a bottom end for hanging an object, the locking structure being a sphere junction, the sphere junction including a sphere body, a connection portion under and connecting to the sphere body, and the sphere body being clamped in the clamping portion for multi-directional rotation, the connection portion being a detachable structure.

wherein the clamping portion has a plurality of curved teeth respectively inwardly extending from a front inner flange and a rear inner flange of the clamping portion to prevent the sphere body from disengaging;

wherein the connection portion includes a bind-around member downwardly extending from a bottom of the sphere body and made integrally in one piece.

2. The tab mechanism as claimed in claim 1, wherein the bind-around member has a gradual-reduced circular sidewall of a funnel shape.

3. The tab mechanism as claimed in claim 2, wherein the bind-around member has a seam formed downwardly from a top of the circular sidewall and a rope engaged in a bottom of the seam to hang the object.

4. A tab mechanism adopted for a zipper slide, the tab mechanism comprising:

a connection member including a banging portion connecting the zipper slide and a clamping portion downwardly extending from the hanging portion, the clamping portion being shaped like a plate, and the clamping portion having a plurality of slots; and a locking structure having a top end connecting the clamping portion of the connection member and a bottom end for hanging an object, the locking structure being plate shaped, and the locking structure including an engaging portion secured in the slot and a detachable structure arranged beneath the engaging portion;

wherein the detachable structure is a detachable hook structure including a male buckle extending from the plate shaped locking structure and a female buckle engaging with the male buckle.

5. The tab mechanism as claimed in claim 4, wherein the female buckle has a rope penetrating therethrough to tie and hang the object.

6. The tab mechanism as claimed in claim 5, wherein the female buckle has a base and a pair of resilient members upwardly and laterally extending from a bottom of the base, and each resilient member is spaced by a gap from the base.

7. The tab mechanism as claimed in claim 1, wherein the clamping portion is in a plate shape, the locking structure is plate-shaped, extends downwardly from the clamping portion and is made integrally in one piece, and the plate shaped locking structure has a detachable hook structure connecting to a bottom thereof for engagement or disengagement.

8. A tab mechanism comprising:

a zipper slide arranged on two teeth tapes;

a connection member including a hanging portion connecting the zipper slide and a clamping portion downwardly extending from the hanging portion; and a sphere junction including a sphere body, and a detachable structure under and connecting to the sphere body, whereby the sphere body is clamped in the clamping portion for multi-directional rotation, and the detachable structure has a bottom for hanging an object;

wherein the detachable structure includes a bind-around member having a gradually reduced circular sidewall of a funnel shape.

9. The tab mechanism as claimed in claim 8, wherein the clamping portion has a plurality of curved teeth respectively inwardly extending from a front inner flange and a rear inner flange of the clamping portion to prevent the sphere body from disengaging.

10. The tab mechanism as claimed in claim 8, wherein the bind-around member has a seam formed downwardly from a top of the circular sidewall and a rope having a knot engaged in a bottom of the seam to hang the object.

11. The tab mechanism as claimed in claim 10, wherein the bind-around member extends downwardly from a bottom of the sphere body and formed integrally therewith in one piece formation.

12. The tab mechanism as claimed in claim 8, wherein the clamping portion is shaped like a plate, and the clamping portion has a plurality of slots.

* * * * *